US009711116B2

(12) United States Patent
Strickland

(10) Patent No.: US 9,711,116 B2
(45) Date of Patent: Jul. 18, 2017

(54) EXPRESSIVE DAMPER FOR A PERCUSSIVE INSTRUMENT

(71) Applicant: Mathew Ephram Strickland, Burlingame, CA (US)

(72) Inventor: Mathew Ephram Strickland, Burlingame, CA (US)

(73) Assignee: Mathew E Strickland, Burlingame, CA (US)

( * ) Notice: Subject to any disclaimer, the term of this patent is extended or adjusted under 35 U.S.C. 154(b) by 0 days.

(21) Appl. No.: 15/226,868

(22) Filed: Aug. 2, 2016

(65) Prior Publication Data

US 2017/0124994 A1 May 4, 2017

Related U.S. Application Data

(60) Provisional application No. 62/201,201, filed on Aug. 5, 2015.

(51) Int. Cl.
*G10D 13/02* (2006.01)

(52) U.S. Cl.
CPC ..... *G10D 13/022* (2013.01)

(58) Field of Classification Search
CPC ..... G10D 13/022
USPC ..... 84/411 M
See application file for complete search history.

(56) References Cited

U.S. PATENT DOCUMENTS

| | | | | |
|---|---|---|---|---|
| 4,671,158 A * | 6/1987 | Saputo | G10D 13/022 | 84/411 M |
| 4,899,635 A * | 2/1990 | Santangelo | G10D 13/022 | 84/411 M |
| 7,511,209 B1 * | 3/2009 | Liao | G10D 13/026 | 84/411 R |
| 2014/0123831 A1 * | 5/2014 | Dunnett | G10D 13/026 | 84/411 R |

* cited by examiner

*Primary Examiner* — Jianchun Qin

(57) ABSTRACT

The invention is a sound modification device used for a percussion instrument. It is comprised of a rigid clip that is spring-based to a closed position and an integrated dampening material, leather or plastic etc., that comes in contact with the vibrating surface. Once the clip is pulled apart it can be released to firmly attach over the hoop of any drum. The musician can choose the size or material of the dampening component to eliminate unwanted ring and or change the resonant note of the drum. The thickness of the dampening component can also be chosen by the drummer to increase or decrease the dampening characteristics.

3 Claims, 10 Drawing Sheets

EXPRESSIVE DAMPER FOR A PERCUSSIVE INSTRUMENT

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention is in the technical field of music. More particularly, the present invention is in the technical field of sound modification. More particularly, the present invention is in the technical field of a sound modification device for any percussion instrument.

PRIOR ART

1. Sound modification device for a percussion instrument
United States Publication number U.S. Pat. No. 8,541,675 B2
Mathew Ephram Strickland Sep. 30, 2009
2. Muting and muffling of drums
United States Publication number U.S. Pat. No. 4,567,807
Robinson David F Nov. 29, 1982
3. Dampening device for a percussion instrument
United States Publication number U.S. Pat. No. 6,696,630 B2 US
Robert A. Gatzen Feb. 34, 2004
4. Sound modification system
United States Patent Application 20070056428
Kind Code A1
May; James H. J R. Mar. 15, 2007

SUMMARY OF THE INVENTION

The sound modification device for a percussion instrument will be referred to as an "expressive damper" for the purpose of this application. The expressive damper is an invention for modifying the sound made by a vibrating surface, or membrane, such as a drumhead used for creating music. This new damper is comprised of a rigid clip that is spring biased for securing the damper to the frame of a vibrating surface such as a drumhead, and a sound dampening component that loosely contacts said surface which allows for said dampening component to rest or lift in response to how soft or hard said surface is struck when played depending upon the dampening component chosen.

DETAILED DESCRIPTION OF THE INVENTION

Figure 1:
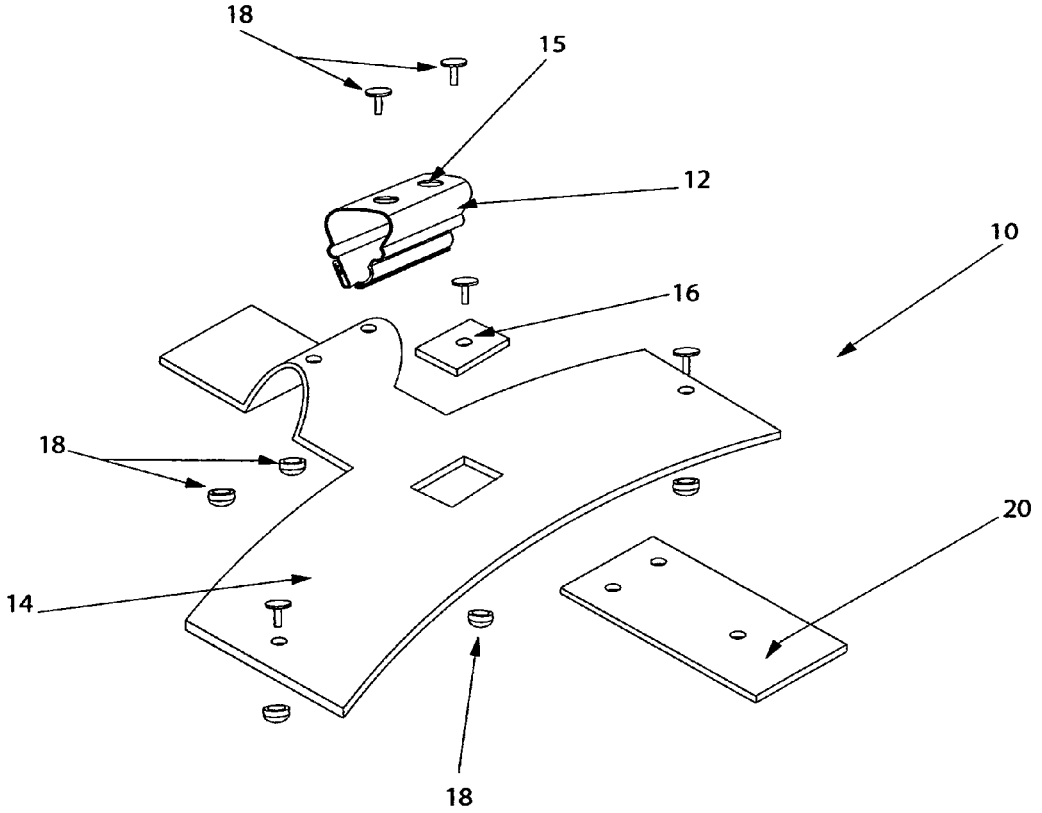
FIG. 1 is an exploded view of the expressive damper.

Referring now to the expressive damper in more detail in FIG. 1; FIG. 1 is an exploded view of the damper according to one embodiment of the present invention and is not intended to limit the scope of the present invention. The damper 10 is shown having a list of parts: spring clip 12 flexible surface 14 magnet 16 rivets 18 the firmer flexible surface 20. The present device will be described more with FIGS. 1 thru 10.

In further detail, still referring to the expressive damper of FIG. 1; The rigid clip 12 may be wood, stone, hard plastic, alloy, or any sufficiently durable surface, but most preferably spring steel. The rigid clip 12 could be wavey, flat, holed, angled, textured, or any combination of these, but most preferably a smooth surface. The flexible surface 14 could be cotton, synthetic leather, plastic, or any combination of soft fibrous materials, but most preferably leather. The flexible surface could be of any weight, size, color, or thickness that best creates desired dampening effect.

The construction details of the damper as shown in FIG. 1;

The form of the rigid clip 12 may be any shape: oval, round, square, triangular, etc, but preferably rectangular in shape. The size of the rigid clip 12 could be, but is not limited to, 10 mm wide×30 mm long×0.30 mm thick. The flexible surface 14 could be constructed out of one or more pieces of leather or a combination of leather and metal or plastic or both. The leather could be attached to a ferrous material and be attracted to the integrated permanent magnet 16 in the said damper. The flexible surface 14 could be attached to the rigid clip 12 by glue, screws, or hook and loop or a rivet 18. The flexible surface 14 could be at least one piece of leather and arranged in any way with the magnet 16 but preferably in the center of leather damper.

Figure 2:
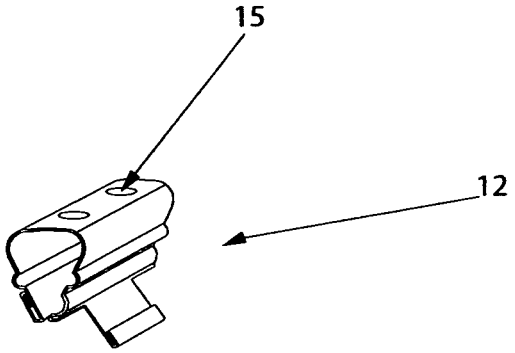
FIG. 2 is the perspective view of just the rigid spring clip of the damper.

Referring now to the clip in FIG. 2; which shows the perspective view of the rigid clip 12. The construction details of the damper as shown in FIG. 2; The rigid clip 12 could be constructed in pieces but most preferably one firm thin piece with a springy quality. It can have holes 15 to accept rivets for attaching the dampening device and opening mechanism.

Figure 3:
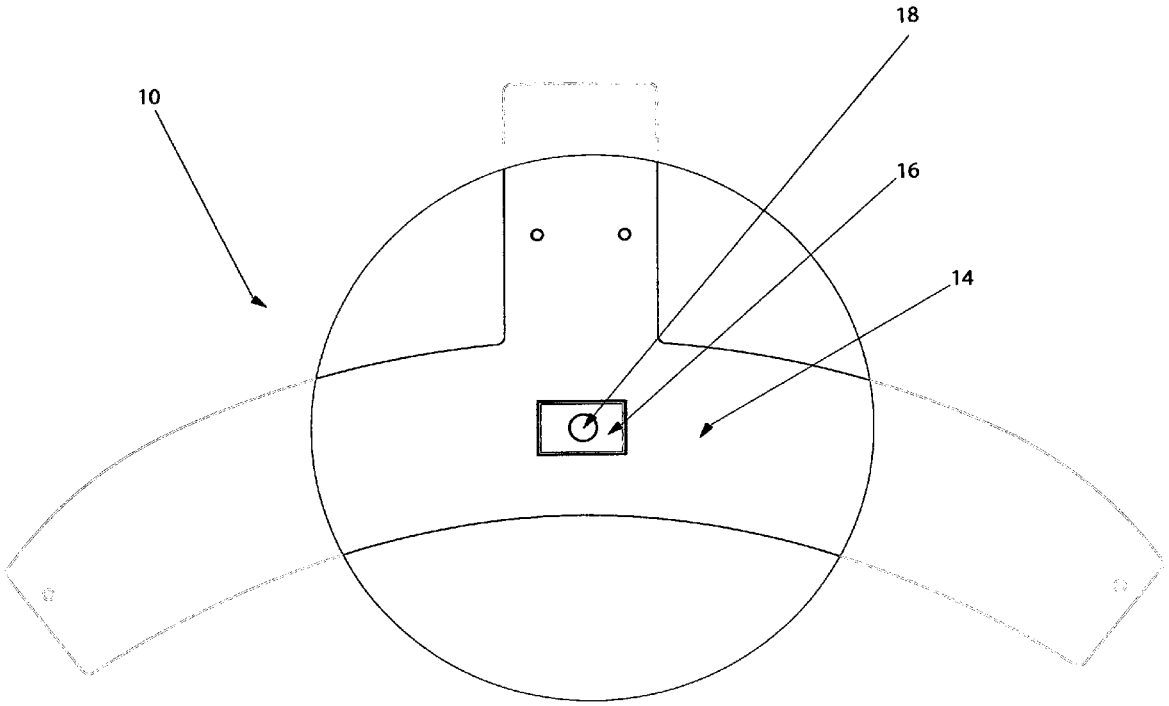
FIG. 3 is a close up perspective view of the magnet within said damper.

Referring now to FIG. 3; of the damper 10 the magnet 16 is shown in the center within the leather dampers' flexible surface 14. The magnet 16 could be any shape or thickness that best with device. The magnet 16 could be glued, riveted, screwed, or adhered in any way to the flexible surface 14 but preferably riveted 18.

Figure 4:
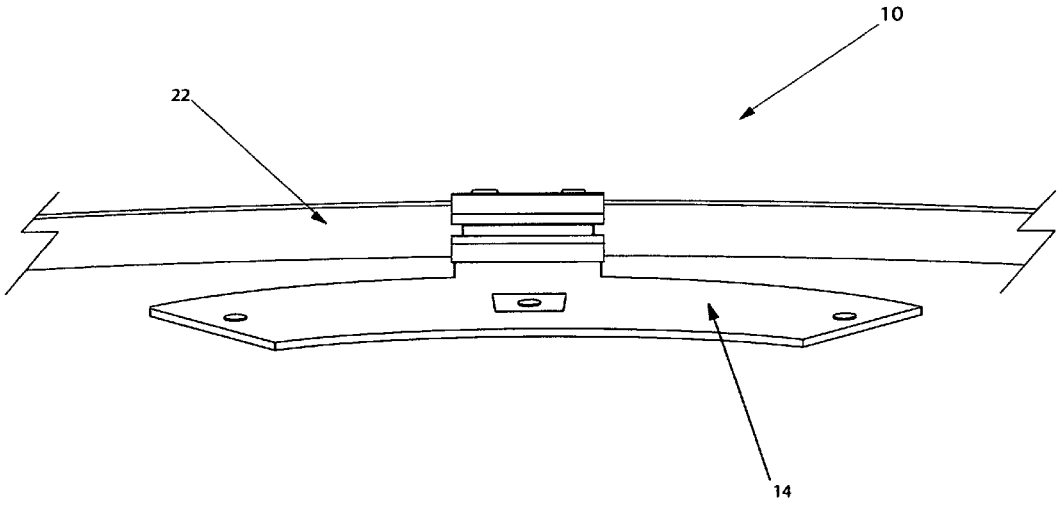
FIG. 4 is the perspective view of the assembled damper attached to rim of drum.

Referring now to FIG. 4; Still referring to the damper 10 the length of the perimeter of the flexible surface 14 could be curved or straight but preferably curved in a way to conform to the inside shape of a standard snare drum rim 22.

Figure 5:
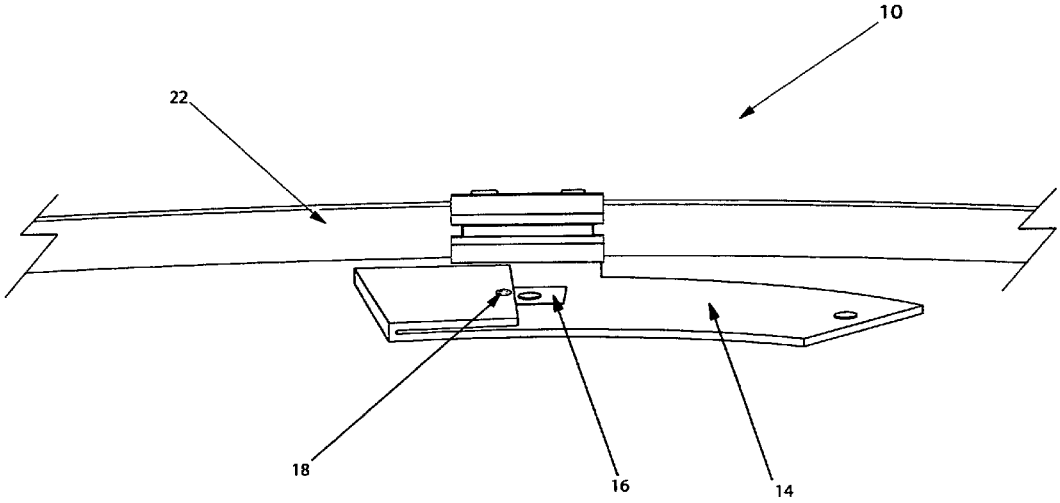
FIG. 5 is a perspective view of the change in size of the damper via ferrous rivets.

Referring now to FIG. 5; any portion of flexible surface 14 can include ferrous materials like rivets 18 to help removeably adhere portions of flexible surface 14 to magnet 16 thus changing the size of expressive damper 10. Within the scope of the construction of this invention, in addition to magnet 16, other on/off fasteners comprised of hook and loop, buttons, zippers and any other fasteners could be used to change the amount of flexible dampening component that comes into contact with the surface of the drumhead.

Figure 6:
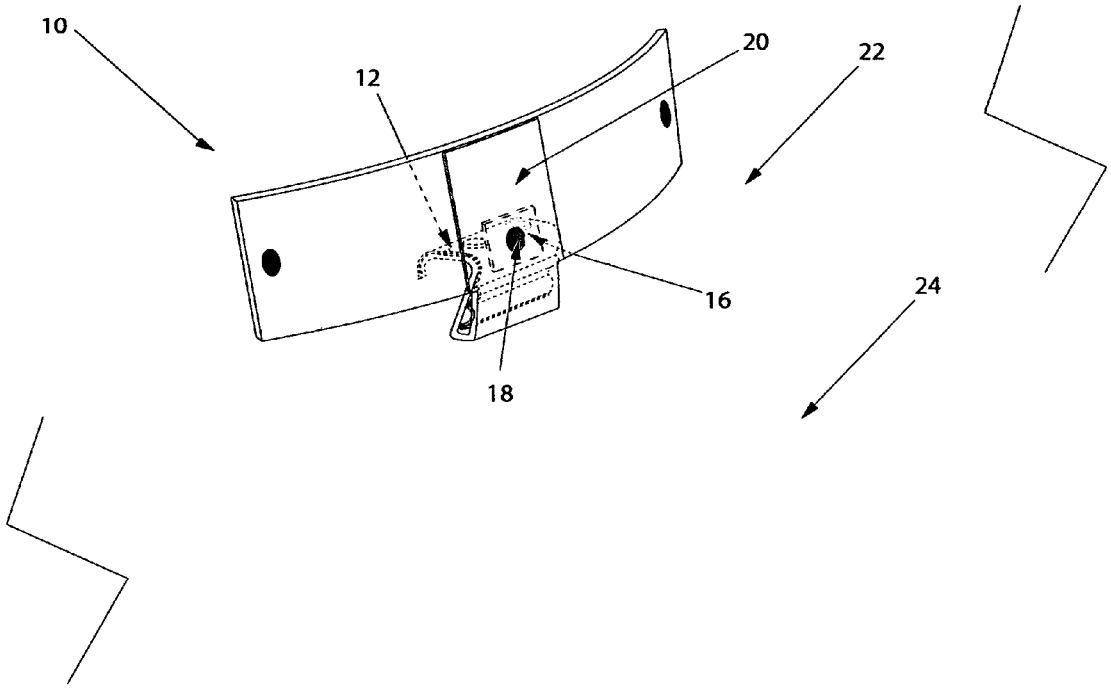
FIG. 6 is a distant perspective view of the storing of expressive damper within the scope of a full sized drum.

Referring now to FIG. 6; shows the expressive damper 10 being stored above the rim 22 of vibrating surface of said drumhead 24 with use of clip 12 and magnet 16. Further construction details show the thinner firmer flexible surface 20 attached to the main leather body and supporting the weight of the damper and magnet 16 held on by its rivet 18.

Figure 7:
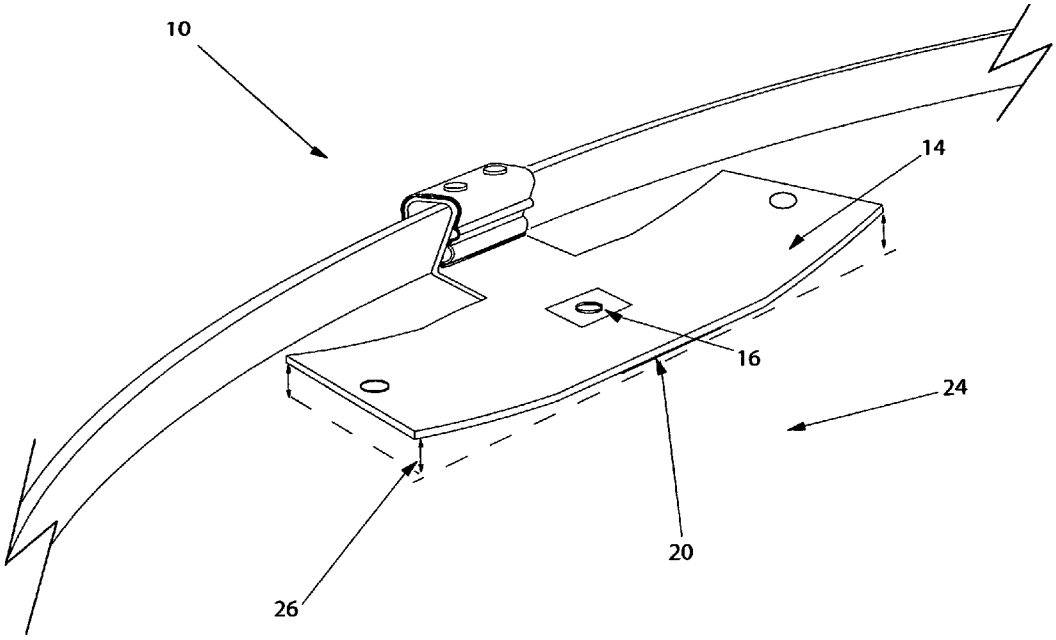
FIG. 7 is a perspective view of the intentional lifting "gated" open and closed movement of the expressive damper.

Referring now to FIG. 7; is a perspective view of the intentional open and closed movement 26 of the flexible surface 14 of the expressive damper 10 vibrating up and away from surface of said drum 24. The amount of lift of dampening component is dependent on the force produced by hitting said drumhead 24, and the density and/or thickness of materials used in said flexible surface 14. The construction details of damper 10 can be such that an adhered flexible surface 20 can be sized to give firmness under the damper 10, preventing lift of the damper from the area to which it was added but extending lift to the lighter and more flexible parts of the damper.

Figure 8:
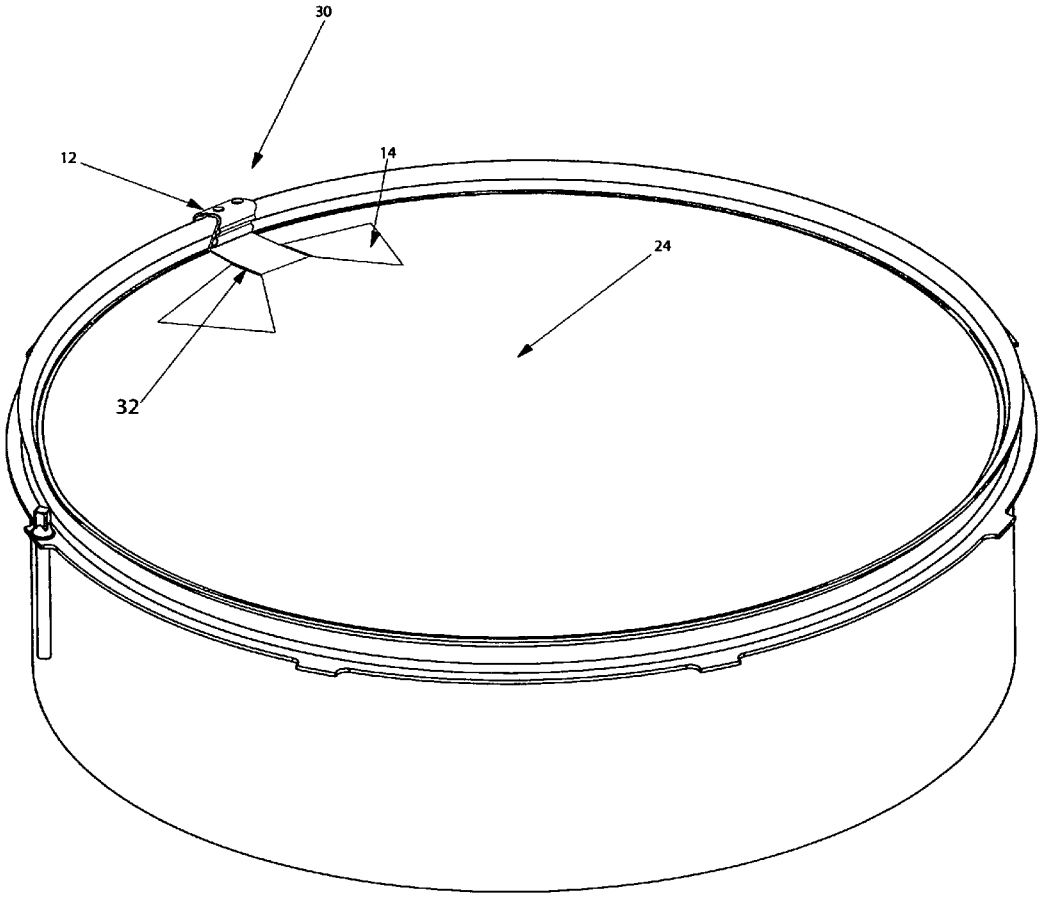
FIG. 8 is the perspective view of an alternate embodiment of the damper.

Referring now to FIG. 8; Still referring to the damper 10 this alternate damper 30 could have different embodiments. In this embodiment, the clip 12 is made from flexible hard plastic as well as the surface 14 which has creased areas 32 with different thickness to allow for movement when drumhead 24 is played. Plastic damper 14 will dampen drum when played quiet and lift off drumhead 24 slightly when played hard. The size of this plastic surface 14 can cover the full drum or part of the drum adding to the dampening properties even further.

Figure 9:
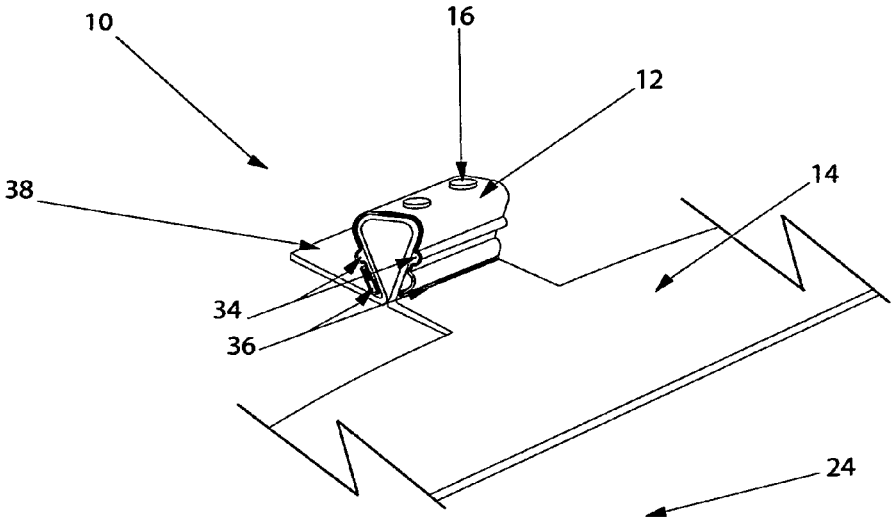
FIG. 9 is the perspective close up of the spring-biased clip in a closed position.

Referring now to FIG. 9; is the perspective close up of the spring-biased clip 12 in a closed position; the leather or plastic damper material 14 runs under the clip 12. The leather damper material 14 is stamped with 2 holes as to accept the rivets 16 from under damper 14 for fastening to clip 12. When opening the clip for installation, grooves 34 are used to spread open clip 12 enough to get damper material 14 with male rivets 16 into holes of clip 12. Once clip 12 is open enough to accept dampening material, the top rivets are added and stamped closed. The instillation grooves 34 are no longer necessary and the opening of the clip 12 is now transferred to pulling tab 38 and damper 14 apart and securing over rim of drum. The rolled metal 36 of clip 14 is designed to prevent the dampening material 14 from ripping at the sharp edges where metal touches damper material in a repetitious way.

Figure 10:
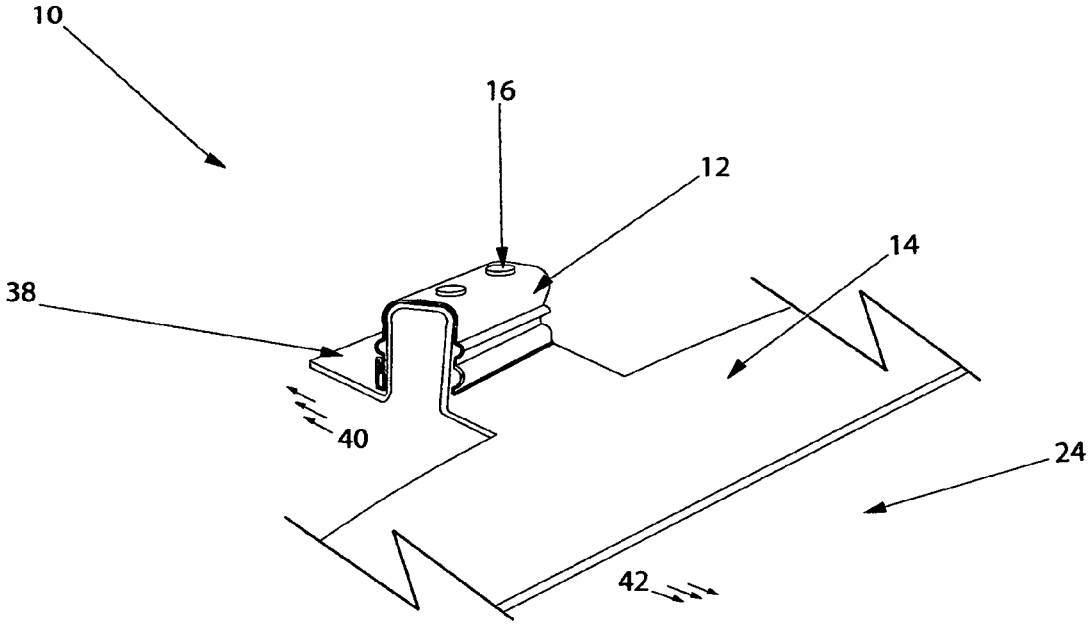
FIG. 10 is the perspective close up of the spring-biased clip in an open position.

Referring now to FIG. 10; is the perspective close up of the spring-biased clip in an open position; it shows the clip 14 being pulled apart with tab 38 and damper material 14. This creates an opposing force 40 and 42 that along with the binding of clip 12 and damper 14 via rivets 16, the spring-biased clip 14 opens. Once the spring biased clip 14 is open, it can be selectively attached to any part of a drum rim.

Method of Use

Pick a spot on the vibrating surface to begin the expressive dampening. Attach the spring-clip on the rim of the drum, using the tab in the back of the clip to open the clip so that the clip can be fitted over the rim of the drum hoop. Push the clip down until the dampening surface makes full contact with the drum skin. Release tab so that spring-clip attaches firmly to hoop. Play the drum and listen for the desired sound change. Try moving the clip to different positions on the drum hoop to test for desired dampening effect before attempting the other dampening options. With soft playing, the flexible dampening surface will move very little when the drum's vibrating surface is struck. With hard playing the flexible dampening surface will lift off the vibrating surface for a more open and "expressive" drum sound, matching the drummers' natural dynamics. To control the amount of dampening: The flexible dampening surface is comprised of two wings, one on each side of the clip. Leave both wings flat against the drum head for the most dramatic sound modification. To decrease the amount of dampening, fold one wing of the dampener so that the corner rivet and center magnet come together to attach. This creates less overall surface contact to the drum head and will lessen the dampened effect of the drum. If the least dampening option is required, fold both left and right sides of the leather containing rivets onto the center magnet. This orientation will damper the percussive sound very little, keeping the drum in its most lively state. For testing, tuning, storage, and, if desired, during play, flip up the entire dampening leather flap component and attach the imbedded center magnet to any part of the ferrous metal clip. The damper is now completely off the drum head, and will not change the sound of the drum. This allows the drummer to quickly go back to the original unaltered sound of the drum, even during the same song!

Advantages

The 1st advantage of the expressive damper is that it allows a change of dampening options depending upon how a drummer strikes the drum. By mixing different materials and working with gravity this new flexible damper can open and close like a gate when the drum is played. The amount of 'opening' and closing' can be controlled by the percussionist's decision to play softer or harder. Current dampers are designed to be "all on" or "all off" the drum head.

The 2nd advantage is that this expressive damper is particularly robust in both construction and materials used. By choosing the right materials: spring clip for the hoop attachment (no screws, glues or braces) hard and soft leather or plastic (which insures both flexibility and durability) the expressive damper will be effective despite weather conditions, will resist breaking and is constructed to last a long time.

The 3rd advantage is that it is both reliable and easy to replicate the sound desired. Once this expressive damper is adjusted via the position on the rim and the position of its material dampening wings to produce the desired sound with the magnet, it is possible to quickly replicate these specific effects at any later time. No longer will a drummer need to cut the right size tape, or gel to get an ideal sound. They can fold or open the flexible leather of the dampening component on any part of the drum head frame.

The 4th advantage is that this expressive damper can be produced for a price that makes it affordable even for beginners.

The 5th advantage is the option to quickly and easily go from a desired dampening state to a state of having no dampening at all. This is achieved by flipping up the dampening surface and securing it away from the drum head by touching the center magnet to the spring-clip. A drummer can play a ringing, jazzy sound, then switch to a rock and roll "thud" tone in the middle of a song.

The $6^{th}$ advantage is that the tab extension allows for the spring-biased clip to be easily opened and allowed to close. This permits the spring-biased clip to be quickly and easily moved to any desired position on the rim of the drum hoop and stays. It eliminates the age old problem of loosening screws or gels that unstick or extruded rubber that loses its position by stretching over time and becoming buzzy with drum head contact.

In a broad embodiment, the present device is an invention for modifying the sound made by a vibratable surface of a percussion instrument controlled "during" play by the drummer. The invention should not be limited by the above described embodiment, method, and examples, but by all embodiments and methods within the scope and spirit of the invention as claimed.

I claim:

1. A vibration-altering device for use with a drum instrument of the type including a membrane that is supported in a stretched state by a rigid frame and which is selectively vibrated when the drum is played, said device comprising: a clip that is spring-biased to a closed position, said clip being sized and shaped to be selectively secured to said rigid frame of said drum instrument against said spring-bias action; and a flexible planar dampening component secured to said clip so that when said clip is secured to said rigid frame of said drum instrument, said dampening component includes a contact surface having a first-size area which contacts said drum membrane and thereby alters, in a first manner, the vibration characteristics of said membrane when said drum is played wherein said flexible planar dampening component is selectively folded so that said contact surface is reduced to having a smaller second-size area which contacts said drum membrane and thereby alters, in a second manner, the vibration characteristics of said membrane when said drum is played; wherein said flexible planar dampening component is held in said folded orientation using magnets.

2. The vibration-altering device of claim 1, wherein said flexible planar dampening component is made from leather, plastic, mylar, rubber or a combination of these materials.

3. The vibration-altering device of claim 1, wherein an extension of flexible component from said flexible planar dampening component becomes a lining along the inside surface of said clip, which is securely attached by rivets to said clip wherein said inner lining extension continues beyond the edge of said clip opposite to that edge closest to the flexible planar dampening component to form a discrete tab structure of said flexible component which provides an opening mechanism and allows said clip to be selectively frictionally-secured to said rigid frame.

* * * * *